US010032427B2

(12) United States Patent
Hu et al.

(10) Patent No.: US 10,032,427 B2
(45) Date of Patent: Jul. 24, 2018

(54) GATE DRIVING METHOD OF PIXEL TRANSISTOR AND GATE DRIVE CIRCUIT, AS WELL AS DISPLAY DEVICE

(71) Applicants: Boe Technology Group Co., Ltd., Beijing (CN); Beijing Boe Display Technology Co., Ltd., Beijing (CN)

(72) Inventors: Weihao Hu, Beijing (CN); Yanping Liao, Beijing (CN); Luqiang Guo, Beijing (CN); Wengang Su, Beijing (CN)

(73) Assignees: BOE TECHNOLOGY TECHNOLOGY CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 137 days.

(21) Appl. No.: 14/913,295

(22) PCT Filed: Jul. 30, 2015

(86) PCT No.: PCT/CN2015/085567

§ 371 (c)(1),
(2) Date: Feb. 19, 2016

(87) PCT Pub. No.: WO2016/155169

PCT Pub. Date: Oct. 6, 2016

(65) Prior Publication Data

US 2017/0039979 A1 Feb. 9, 2017

(30) Foreign Application Priority Data

Mar. 27, 2015 (CN) ..... 2015 1 0142728

(51) Int. Cl.
*G09G 3/36* (2006.01)

(52) U.S. Cl.
CPC ..... *G09G 3/3696* (2013.01); *G09G 3/36* (2013.01); *G09G 3/3648* (2013.01);
(Continued)

(58) Field of Classification Search
CPC ..... G09G 3/3696; G09G 3/36; G09G 3/3648; G09G 3/3674; G09G 3/3688; G09G 3/3233; G09G 3/3241
(Continued)

(56) References Cited

U.S. PATENT DOCUMENTS 3,902,082 A * 8/1975 Proebsting ..... G11C 11/4082 326/106
9,698,675 B2 * 7/2017 Zhang ..... H02M 3/07
(Continued)

FOREIGN PATENT DOCUMENTS

CN 101425268 5/2009
CN 103403786 11/2013
(Continued)

OTHER PUBLICATIONS

Office Action from China Application No. 201510142728.2 dated Sep. 29, 2016.
(Continued)

*Primary Examiner* — Fred Tzeng
(74) *Attorney, Agent, or Firm* — Calfee, Halter & Griswold LLP

(57) ABSTRACT

The present invention discloses a gate driving method of a pixel transistor and a gate drive circuit, as well as a display device including the gate drive circuit, which falls within the field of display technology. The method comprises the steps of: a gate drive circuit outputting a preset first voltage to a gate driving line of a pixel row prior to a transistor turn-on time of the pixel row, wherein the first voltage is greater than a transistor turn-off voltage; and the gate drive circuit
(Continued)

outputting a transistor turn-on voltage to the gate driving line of the pixel row when it reaches the transistor turn-on time. Use of the present invention can improve the accuracy of pixel display.

14 Claims, 5 Drawing Sheets

(52) U.S. Cl.
CPC ... *G09G 3/3674* (2013.01); *G09G 2300/0809* (2013.01); *G09G 2310/0251* (2013.01); *G09G 2310/06* (2013.01); *G09G 2320/0223* (2013.01); *G09G 2320/0252* (2013.01)

(58) Field of Classification Search
USPC ..... 345/215
See application file for complete search history.

(56) References Cited

U.S. PATENT DOCUMENTS

2002/0121882 A1* 9/2002 Matsuo ..... G05F 1/565 323/266
2005/0231984 A1* 10/2005 Wang ..... H02M 3/33576 363/16
2006/0158421 A1* 7/2006 Masuko ..... G09G 3/3688 345/100
2009/0189590 A1* 7/2009 Ide ..... G05F 3/30 323/313
2009/0256782 A1* 10/2009 Asano ..... G09G 3/3241 345/76
2009/0267655 A1* 10/2009 Chen ..... G09G 3/3696 327/108
2010/0053233 A1* 3/2010 Ishiguro ..... G09G 3/3233 345/690
2013/0321386 A1* 12/2013 Murai ..... G09G 3/3648 345/213

FOREIGN PATENT DOCUMENTS

CN 104778931 7/2015
KR 20080069441 7/2008

OTHER PUBLICATIONS

Second Office Action from China Application No. 201510142728.2 dated Apr. 7, 2017.
International Search Report and Written Opinion from PCT/CN15/85567 dated Dec. 18, 2015.
Decision on Rejection for Chinese Patent Application No. 201510142728.2 dated Oct. 17, 2017.

* cited by examiner

GATE DRIVING METHOD OF PIXEL TRANSISTOR AND GATE DRIVE CIRCUIT, AS WELL AS DISPLAY DEVICE

RELATED APPLICATIONS

The present application is the U.S. national phase entry of PCT/CN2015/085567 with an International filing date of Jul. 30, 2015, which claims the benefit of Chinese Application No. 201510142728.2, filed Mar. 27, 2015, the entire disclosures of which are incorporated herein by reference.

FIELD OF THE INVENTION

The present invention relates to the field of display technology, and more particularly to a gate driving method of a pixel transistor and a gate drive circuit, as well as a display device including the gate drive circuit.

BACKGROUND ART

In liquid crystal display devices, a pixel circuit is arranged for each pixel so as to display the corresponding pixel. Each pixel circuit is provided therein with a pixel transistor and a pixel capacitor. A liquid crystal display device is provided therein with a gate drive circuit for gate driving of the pixel transistors in the pixel circuits, i.e., for controlling the ON/OFF of the pixel transistors. When a pixel transistor is turned on, a data voltage will charge the respective pixel capacitor through the pixel transistor. The charged pixel capacitor can control the output of corresponding optical signals.

Generally speaking, the gate drive circuit is provided with a plurality of output ports with each output port being connected with a gate driving line of a pixel row, and the gate driving line being connected with the gates of the pixel transistors of all the pixel circuits in the pixel row. The gate drive circuit outputs a drive voltage to a connected gate driving line through some output port, so as to control the turn-on and turn-off of the pixel transistors of all the pixel circuits in the corresponding pixel row. When the drive voltage is a high level transistor turn-on voltage VGH, the pixel transistor is turned on, and when the drive voltage is a low level transistor turn-off voltage VGL, the pixel transistor is turned off.

SUMMARY OF THE INVENTION

In designing the present invention, the inventor finds that the prior art has at least the following defects:

There exists a resistor and a parasitic capacitor on the gate driving line of each pixel row, which will give rise to delay of the drive voltage transmission. Thus, the turn-on of the pixel transistors far away from the gate drive circuit will be greatly delayed, such that the corresponding pixel capacitor cannot be sufficiently charged, thereby leading to inaccurate display of pixels.

In order to solve or alleviate at least one of the defects or issues in the prior art, the embodiments of the present invention provide a gate driving method of a pixel transistor and a gate drive circuit, as well as a display device including the gate drive circuit.

According to one aspect of the present invention, the gate driving method of the pixel transistor is provided, the method comprising the steps of:

a gate drive circuit outputting a preset first voltage to a gate driving line of a pixel row prior to a transistor turn-on time of the pixel row, wherein the first voltage is greater than a transistor turn-off voltage; and the gate drive circuit outputting a transistor turn-on voltage to the gate driving line of the pixel row when it reaches the transistor turn-on time.

Optionally, the first voltage is less than the transistor turn-on voltage.

Optionally, the step of a gate drive circuit outputting a preset first voltage to a gate driving line of a pixel row prior to a transistor turn-on time of the pixel row comprises:

the gate drive circuit outputting a preset first voltage to the gate driving line of the pixel row from a preset time period prior to the transistor turn-on time of the pixel row.

Optionally, the preset time period is less than the time difference between the transistor turn-off time of the pixel row and the transistor turn-on time of the pixel row.

Optionally, the method further comprises: the gate drive circuit stopping outputting the transistor turn-on voltage to the gate driving line of the pixel row, but outputting the transistor turn-off voltage to the gate driving line, when it reaches the transistor turn-off time of the pixel row.

Optionally, the step of a gate drive circuit outputting a preset first voltage to a gate driving line of a pixel row prior to the transistor turn-on time of the pixel row comprises:

the gate drive circuit outputting the preset first voltage to the gate driving line of the pixel row under the control of a first control signal, prior to the transistor turn-on time of the pixel row.

Optionally, the step of the gate drive circuit outputting a transistor turn-on voltage to the gate driving line of the pixel row when it reaches the transistor turn-on time comprises:

the gate drive circuit, under the control of a second control signal, stopping outputting the first voltage to the gate driving line, but outputting the transistor turn-on voltage to the gate driving line, when it reaches the transistor turn-on time.

Optionally, the method further comprises: the gate drive circuit, under the control of the second control signal, stopping outputting the transistor turn-on voltage to the gate driving line, but outputting the transistor turn-off voltage to the gate driving line, when it reaches the transistor turn-off time of the pixel row.

According to another aspect of the present invention, a gate drive circuit is provided, which comprises:

a precharge module configured to output a preset first voltage to a gate driving line of a pixel row prior to the transistor turn-on time of the pixel row, wherein the first voltage is greater than a transistor turn-off voltage;

a control module configured to output a transistor turn-on voltage to the gate driving line of the pixel row when it reaches the transistor turn-on time.

Optionally, the first voltage is less than the transistor turn-on voltage.

Optionally, the precharge module is configured to:

output a preset first voltage to the gate driving line of the pixel row from a preset time period prior to the transistor turn-on time of the pixel row.

Optionally, the preset time period is less than the time difference between the transistor turn-off time of the pixel row and the transistor turn-on time of the pixel row.

Optionally, the control module is also configured to:

stop outputting the transistor turn-on voltage to the gate driving line, but output the transistor turn-off voltage to the gate driving line, when it reaches the transistor turn-off time of the pixel row.

Optionally, the precharge module is configured to:

output the preset first voltage to the gate driving line of the pixel row under the control of a first control signal, prior to the transistor turn-on time of the pixel row.

Optionally, the control module is configured to:

under the control of a second control signal, stop outputting the first voltage to the gate driving line, but output the transistor turn-on voltage to the gate driving line, when it reaches the transistor turn-on time.

Optionally, the control module is also configured to:

under the control of the second control signal, stop outputting the transistor turn-on voltage to the gate driving line, but output the a transistor turn-off voltage to the gate driving line, when it reaches the transistor turn-off time of the pixel row.

According to a further aspect of the present invention, a display device is provided, which comprises any gate drive circuit as stated above.

The technical solutions provided by the embodiments of the present invention can achieve at least one of the following advantageous effects and/or other advantageous effects:

the parasitic capacitor on the gate driving line is charged prior to the transistor turn-on time, such that when the gate drive circuit outputs the transistor turn-on voltage to the gate driving line at the transistor turn-on time, it is possible to reduce the delay in transmitting the transistor turn-on voltage, increase the time for charging the pixel capacitor, and improve the accuracy of pixel display.

BRIEF DESCRIPTION OF DRAWINGS

To explain the technical solutions in the embodiments of the present invention more clearly, the drawings necessary for describing the embodiments will be briefly introduced. It should be realized that the following drawings are only related to some embodiments of the present invention. Those skilled in the art can obtain other drawings according to these drawings without making an inventive labour.

DETAILED DESCRIPTION OF THE INVENTION

To make clearer the object, technical solutions and advantages of the present invention, the embodiments of the present invention will be further described in detail with reference to drawings.

Figure 1:
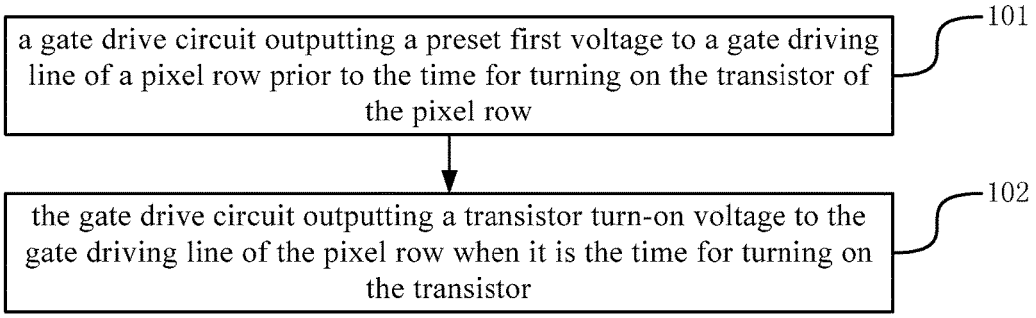
FIG. 1 is a flow chart of a gate driving method of a pixel transistor according to an embodiment of the present invention.

A gate driving method of a pixel transistor is provided according to an embodiment of the present invention. As shown in FIG. 1, the process of the method comprises the steps of:

step 101: a gate drive circuit outputting a preset first voltage to a gate driving line of a pixel row prior to the transistor turn-on time of the pixel row, wherein the first voltage is greater than a transistor turn-off voltage; and step 102: the gate drive circuit outputting a transistor turn-on voltage to the gate driving line of the pixel row when it reaches the transistor turn-on time. In a specific implementation, when it reaches the transistor turn-on time of the pixel row, the gate drive circuit stops outputting the first voltage to the gate driving line, but outputs a transistor turn-on voltage to the gate driving line.

It needs to be pointed out that the above method is applicable for any pixel row of the display device. Nevertheless, those skilled in the art can realize that the above method can drive each pixel row of the display device on a row-by-row basis.

By means of the above method, the parasitic capacitor on the gate driving line can be charged prior to the transistor turn-on time. In this way, when the gate drive circuit outputs the transistor turn-on voltage to the gate driving line at the transistor turn-on time, it is possible to reduce the delay in transmitting the transistor turn-on voltage, increase the time for charging the pixel capacitor, and improve the accuracy of pixel display.

A gate driving method of a pixel transistor is provided according to an embodiment of the present invention. The subject that implements the method can be the gate drive circuit in the display device. The gate drive circuit can control the turn-on and turn-off of pixel transistors in a plurality of pixel rows. The gate drive circuit can comprise a plurality of output ports with each output port being respectively connected with a gate driving line of a pixel row.

The processing flow as shown in FIG. 1 will be described in detail with reference to the specific implementing process as follows:

step 101: a gate drive circuit outputting a preset first voltage to a gate driving line of a pixel row prior to the transistor turn-on time of the pixel row.

Figure 2:
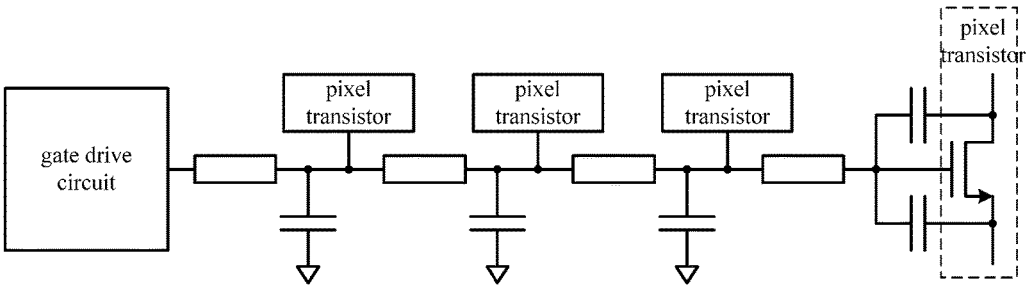
FIG. 2 is a schematic view of an equivalent parasitic capacitor of a gate driving line according to an embodiment of the present invention.

Wherein, the gate driving line is the line that connects the output port of the gate drive circuit with the gate of the pixel transistor of each pixel circuit in the corresponding pixel row. An equivalent parasitic capacitor of the gate driving line can be as shown in FIG. 2. The pixel row in FIGS. 1 and 2 can be any pixel row controlled by the gate drive circuit. The transistor turn-on time is the time for inputting the transistor turn-on voltage VGH to the gates of the pixel transistors in the pixel row. Although in this specific implementation, the transistor turn-on voltage is a high level VGH, those skilled in the art can realize that the transistor turn-on voltage in other implementations can also be a low level voltage. The first voltage can also be called a precharge voltage, represented by VGM, for charging the parasitic capacitor on the gate driving line. The first voltage can be arranged to be greater than the transistor turn-off voltage.

In a specific implementation, the transistor turn-on time and the transistor turn-off time can be set for each pixel row. The time period therebetween is the turn-on time period of a corresponding transistor, i.e. the time period during which the data voltage of each pixel in the corresponding pixel row charges the pixel capacitor. The time periods to which the pixel rows each correspond are arranged in a time sequence, i.e., the transistor turn-off time of the first pixel row is followed by the transistor turn-on time of the second pixel row, and the transistor turn-off time of the second pixel row is followed by the transistor turn-on time of the third pixel row, and so on and so forth. As to any pixel row, at any time prior to the transistor turn-on time thereof, the gate drive circuit can output the precharge voltage VGM to the gate driving line of the pixel row through a corresponding output port. Before the output of VGM, what is output by the gate drive circuit to the gate driving line is the transistor turn-off voltage VGL. Since VGM is greater than VGL, VGM starts to charge the parasitic capacitor on the gate driving line when VGM is being output.

The ways to output VGM by the gate drive circuit are of great variety. The gate drive circuit can be added with two channels of input signals, wherein one channel is to input VGM constant signals, and the other is to input corresponding enable signals for triggering the gate drive circuit to output VGM outside, which will be elaborated later. Or it is also possible to not add input signals, but to adjust the original input signals of the transistor turn-on voltage in the gate drive circuit from VGH constant signals to signals that alternate between VGM level and VGH level (the time when VGM jumps to VGH is the transistor turn-on time), and advance the time for inputting the enable signals of the transistor turn-on voltage by a certain time period.

Optionally, the voltage range of the first voltage can be further limited so as to make the first voltage less than the transistor turn-on voltage.

In a specific implementation, the value of VGH ranges from 25V to 35V, that of VGL ranges from −4V to −8V, and the value of VGM can be correspondingly arranged between VGH and VGL, such as 3V. When the gate drive circuit inputs VGM into the gates of the pixel transistors of a pixel row through the gate driving line of the pixel row, the data voltage passing through the pixel transistors is the one of the previous pixel row because it is not the transistor turn-on time of the pixel row. Because the value of VGM is set between VGH and VGL, the pixel transistors of the pixel row at this time enter into a slightly-ON state, such that the pixel capacitor is charged less charges, which may reduce the influence of the data voltage of the previous pixel row on the present pixel row.

Optionally, a reasonable time period for inputting can be set for the first voltage. Correspondingly, the process of the step 101 can be made as follows: the gate drive circuit outputting a preset first voltage to a gate driving line of the pixel row from a preset time period prior to the transistor turn-on time of the pixel row.

Further optionally, the preset time period can be set to be less than the time difference between the transistor turn-off time of the pixel row and the transistor turn-on time of the pixel row, namely less than the turn-on duration of the transistor.

In a specific implementation, a relatively small time period can be selected as the preset time period according to actual demands. For instance, the preset time period can be 10% of the time difference between the transistor turn-off time and the transistor turn-on time, namely 10% of the turn-on duration of the transistor. When the gate drive circuit inputs VGM into the gates of the pixel transistors of the pixel row through the gate driving line of the pixel row, the data voltage passing through the pixel transistors is the one of the previous pixel row because it is not the transistor turn-on time of the pixel row. Since the preset time period is set to be relatively short, the pixel capacitor is charged less charges, which may reduce the influence of the data voltage of the previous pixel row on the present pixel row.

In step 102, the gate drive circuit outputs a transistor turn-on voltage to the gate driving line of the pixel row when it reaches the transistor turn-on time. In a specific implementation, when it reaches the transistor turn-on time of the pixel row, the gate drive circuit stops outputting the first voltage to the gate driving line, but outputs a transistor turn-on voltage to the gate driving line.

In a specific implementation, when it reaches the transistor turn-on time, the output voltage can jump from VGM to VGH, and at this time, the data voltage changes from the data voltage of the previous pixel row to the data voltage of the pixel row. The pixel transistors of the pixel row enter into a turn-on state, and the current data voltage charges the pixel capacitors of the pixel row.

Optionally, the pixel transistors can be turned off subsequently. Correspondingly, the following step can be made after the step 102: the gate drive circuit stops outputting the transistor turn-on voltage to the gate driving line of the pixel row, but outputs the transistor turn-off voltage to the gate driving line, when it reaches the transistor turn-off time of the pixel row.

In a specific implementation, when it reaches the transistor turn-off time, the output voltage can jump from VGH to VGL, and at this time, the input of the data voltage of the pixel row comes to an end. The pixel transistors of the pixel row enter into a turn-off state and the charging of the pixel capacitors ceases. Then, each pixel capacitor of the pixel row outputs the voltage and the corresponding pixel content is displayed.

Figure 3A:
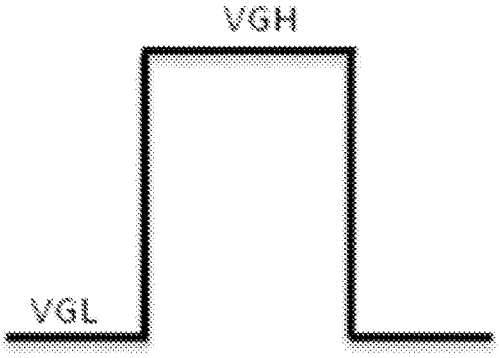
FIGS. 3*a*, 3*b* and 3*c* are waveform diagrams of voltages at different positions of the gate driving line in the prior art.
Figure 3B:
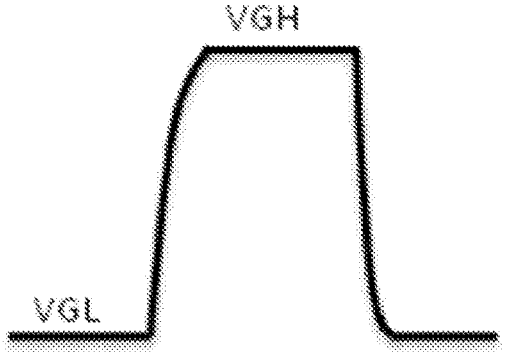
Figure 3C:
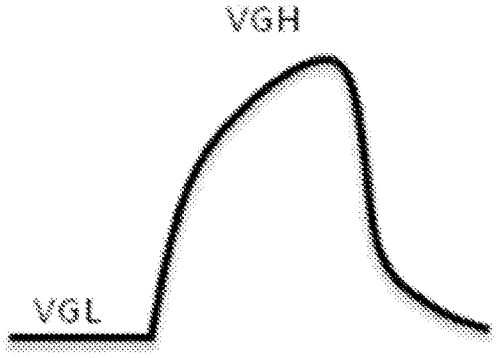
Figure 4A:
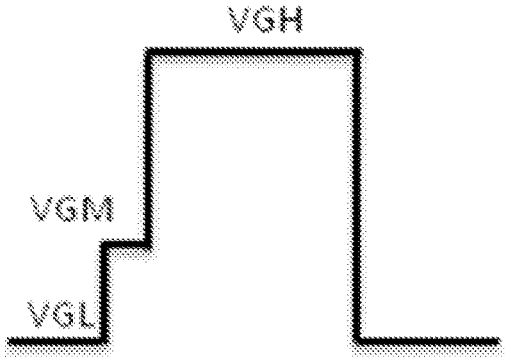
FIGS. 4*a*, 4*b* and 4*c* are waveform diagrams of voltages at different positions of the gate driving line according to an embodiment of the present invention.
Figure 4B:
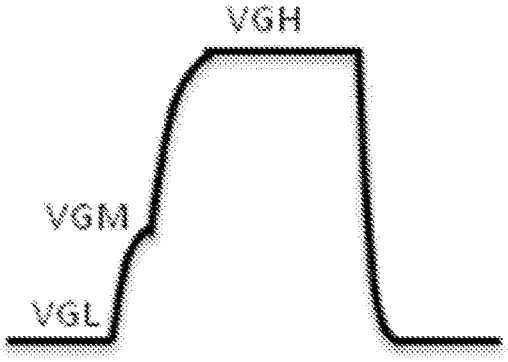
Figure 4C:
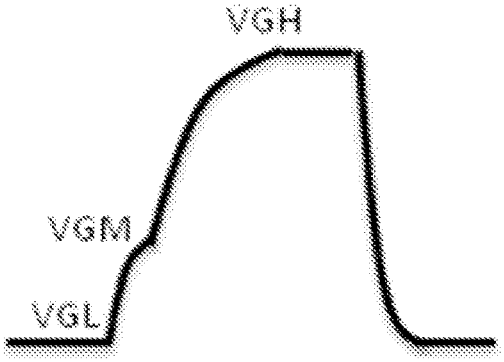

FIGS. 3*a*, 3*b* and 3*c* are waveform diagrams of voltages at different positions of the gate driving line in the event of not outputting VGM in the prior art. The waveform of the voltage at the output port of the gate drive circuit is shown in FIG. 3*a*, the waveform of the gate input voltage for the pixel transistor that is closer to the output port is shown in FIG. 3*b*, and the waveform of the gate input voltage for the pixel transistor that is further away the output port is shown in FIG. 3*c*. FIGS. 4*a*, 4*b* and 4*c* are waveform diagrams of voltages at different positions of the gate driving line when using the processing flow of the above embodiment. The waveform of the voltage at the output port of the gate drive circuit is shown in FIG. 4*a*, the waveform of the gate input voltage for the pixel transistor that is closer to the output port is shown in FIG. 4*b*, and the waveform of the gate input voltage for the pixel transistor that is further away the output port is shown in FIG. 4*c*. It can thus be seen that the processing flow of the above embodiment can effectively prolong the valid time for charging the pixel capacitor.

As stated above, in order to achieve the processing of the flow, the gate drive circuit can be added with two channels of input signals, wherein one channel is to input VGM constant signal, and the other is to input corresponding enable signals for triggering the gate drive circuit to output VGM outside. Correspondingly, the step 101 can has a process as follows: prior to the transistor turn-on time of a pixel row, the gate drive circuit outputs the preset first voltage to the gate driving line of the pixel row under the control of a first control signal. Correspondingly, the step 102 can has a process as follows: the gate drive circuit, under the control of a second control signal, stops outputting the first voltage to the gate driving line, but outputs a transistor turn-on voltage to the gate driving line, when it reaches the transistor turn-on time. In addition, the process after the step 102 can be as follows: the gate drive circuit, under the control of the second control signal, stops outputting the transistor turn-on voltage to the gate driving line of the pixel row, but outputs the transistor turn-off voltage to the gate driving line, when it reaches the transistor turn-off time of the pixel row.

Figure 5:
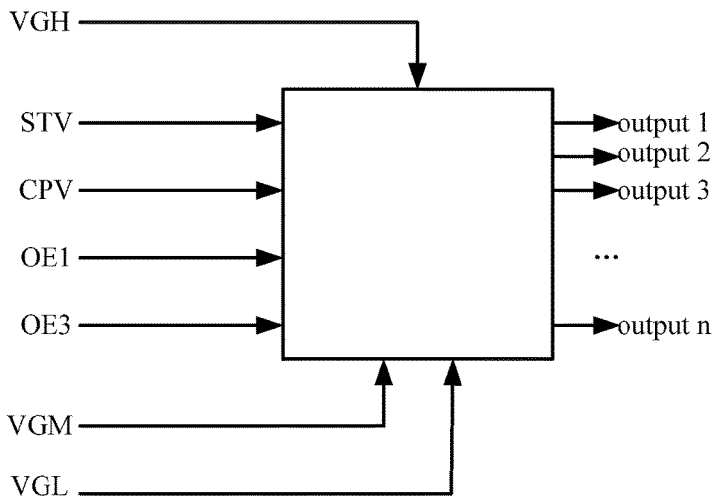
FIG. 5 is a schematic view showing the input and output signals of a gate drive circuit according to an embodiment of the present invention.
Figure 6:
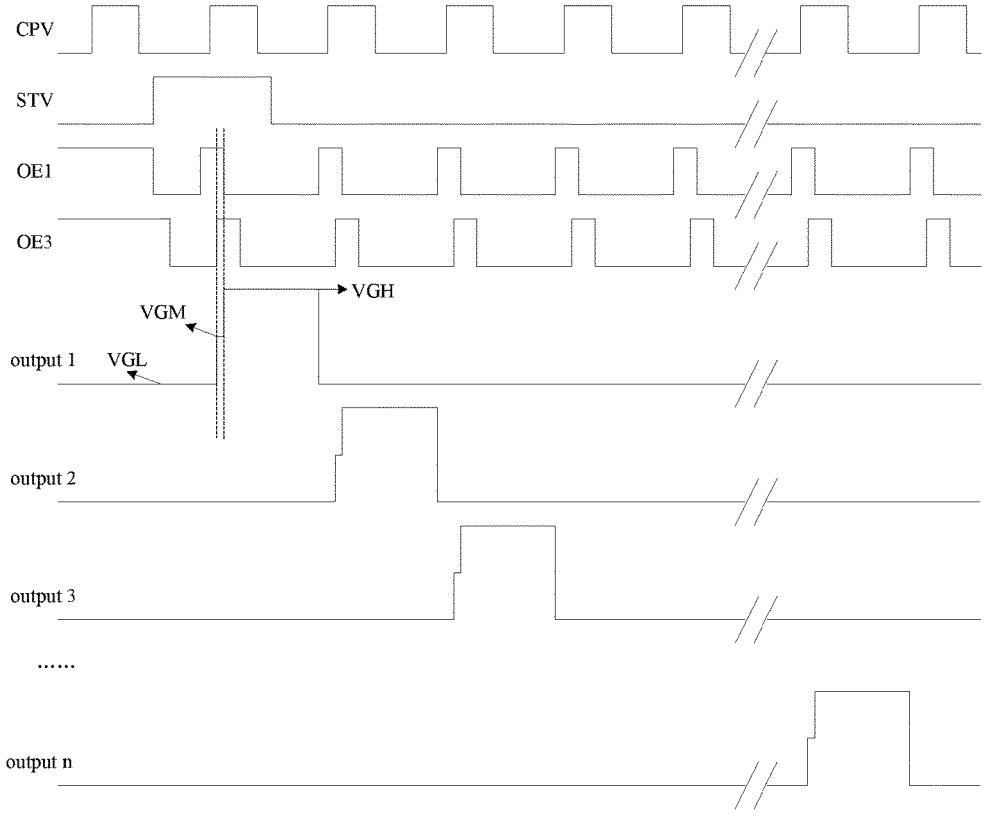
FIG. 6 illustrates waveform diagrams of the input and output signals of the gate drive circuit according to an embodiment of the present invention.

In a specific implementation, the input and output signals of the gate drive circuit is shown in FIG. 5, and the waveforms of the signals are shown in FIG. 6, wherein STV is a frame start signal, CPV is a row switch signal for switching the current pixel row. Constant signals VGH, VGM and VGL are respectively input at input ports VGH, VGM and VGL. The output 1, output 2 . . . ouput n correspond to a plurality of output ports of the gate drive circuit. Each output port is connected with the gate driving line of a pixel row for outputting the drive voltage to the connected gate driving line so as to drive the pixel transistors of all pixel circuits in the corresponding pixel row. In the embodiment, the output port is configured to output the transistor turn-on voltage VGH, the transistor turn-off voltage VGL or the precharge voltage VGM. OE1 is the enable signal of VGH for controlling the beginning and ending of the VGH output. OE3 is the enable signal of VGM for triggering the VGM output. The rising edge of OE3 triggers the gate drive circuit to output VGM. The falling edge of OE1 triggers the gate drive circuit to stop outputting VGM, but to output VGH, i.e., the time of the falling edge is the transistor turn-on time, and the rising edge of OE1 triggers the gate drive circuit to stop outputting VGH, but to output VGL, i.e., the time of the rising edge is the transistor turn-off time.

In the above embodiment, the parasitic capacitor on the gate driving line is charged prior to the transistor turn-on time, such that when the gate drive circuit outputs the transistor turn-on voltage to the gate driving line at the transistor turn-on time, it is possible to reduce the delay in transmitting the transistor turn-on voltage, increase the time for charging the pixel capacitor, and improve the accuracy of pixel display.

Figure 7:
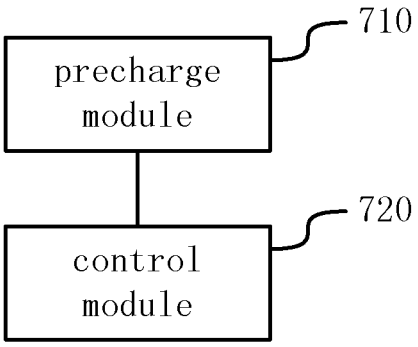
FIG. 7 is a structural schematic view of the gate drive circuit according to an embodiment of the present invention.

A gate drive circuit is provided according to another embodiment of the present invention. The gate drive circuit and the gate driving method of the pixel transistor in the above embodiment are based on the same technical concept, so reference can be made to the contents of the above method as for the operation manners of the modules in the gate drive circuit. As shown in FIG. 7, the gate drive circuit may comprise:

a precharge module 710 configured to output a preset first voltage to a gate driving line of a pixel row prior to the transistor turn-on time of the pixel row, wherein the first voltage is greater than a transistor turn-off voltage;

a control module 720 configured to output a transistor turn-on voltage to the gate driving line of the pixel row when it reaches the transistor turn-on time. In a specific implementation, when it reaches the transistor turn-on time, the control module 720 stops outputting the first voltage to the gate driving line of the pixel row, but outputs a transistor turn-on voltage to the gate driving line.

Optionally, the first voltage is less than the transistor turn-on voltage.

Optionally, the precharge module 710 is configured to:

output a preset first voltage to the gate driving line of the pixel row from a preset time period prior to the transistor turn-on time of the pixel row.

Optionally, the preset time period is less than the time difference between the transistor turn-off time of the pixel row and the transistor turn-on time of the pixel row.

Optionally, the control module 720 is also configured to:

stop outputting the transistor turn-on voltage to the gate driving line of the pixel row, but output the transistor turn-off voltage to the gate driving line, when it reaches the transistor turn-off time of the pixel row.

Optionally, the precharge module 710 is configured to:

output the preset first voltage to the gate driving line of the pixel row under the control of a first control signal, prior to the transistor turn-on time of the pixel row.

Optionally, the control module 720 is configured to:

under the control of a second control signal, stop outputting the first voltage to the gate driving line of the pixel row, but output the transistor turn-on voltage to the gate driving line, when it reaches the transistor turn-on time.

Optionally, the control module 710 is also configured to:

under the control of the second control signal, stop outputting the transistor turn-on voltage to the gate driving line of the pixel row, but output the transistor turn-off voltage to the gate driving line, when it reaches the transistor turn-off time of the pixel row.

A display device is provided according to a further embodiment of the present invention. The display device comprises any gate drive circuit as stated above for gate driving of the pixel rows of the display device. The gate drive circuit and corresponding gate driving method have been elaborated above and will not be reiterated herein.

It needs to be explained that the above embodiments are illustrated based on the above division of the various functional modules. In actual application, the above functions can be achieved by different functional modules as required. The internal structure of the device can be divided into different functional modules to wholly or partially achieve the functions as stated above. Moreover, the function of one module can be realized by a plurality of modules, and the functions of the plurality of modules can also be integrated into one module.

In the above embodiments of the present invention, the parasitic capacitor on the gate driving line is charged prior to the transistor turn-on time, such that when the gate drive circuit outputs the transistor turn-on voltage to the gate driving line at the transistor turn-on time, it is possible to reduce the delay in transmitting the transistor turn-on voltage, increase the time for charging the pixel capacitor, and improve the accuracy of pixel display.

It is appreciated that the above embodiments are only exemplary for the sake of explaining the principle of the present invention, and the present invention should not be limited thereto. As far as those skilled in the art are concerned, various variations and modifications can be made without departing from the spirit and nature of the present invention and shall be deemed as falling within the protection scope of the present invention. The protection scope of the present invention depends on the protection scope of the appended claims.

The term "and/or" used herein is only used to describe the connecting relations between objects connected thereby, which may be of three types. For instance, "A and/or B" can represent the following three conditions: either A alone, or B alone, or both A and B. In addition, the character "/" used herein often indicates that the former and the latter objects connected thereby is in a "or" relationship.

The words, such as "first", "second" and "third", are used in the present application. Such a word is not intended to imply ordering but for the sake of identification, unless in a certain context. For instance, the expressions "the first version" and "the second version" do not necessarily mean that the first version is just the No. 1 version or created prior to the second version, or the first version is required or operated before the second version. In fact, these expressions are used to identify the different versions.

In the claims, any reference numeral in parentheses should not be interpreted as a limitation to the claims. The term "comprise" does not exclude the presence of elements or steps other than those listed in the claims. The words "a" or "an" in front of elements do not exclude the possibility of a plurality of such elements. The present invention can be carried out by means of hardware comprising a plurality of separate elements, or by appropriately programmed software or firmware, or by any combination thereof.

In device or system claims that enumerate several means, one or more of the means can be embodied by one and the same item of hardware. The mere fact that some measure is recited in dependent claims that are different from each other does not indicate that the combination of the measures cannot be used to advantage.

The invention claimed is:

1. A gate driving method of a pixel transistor, the method comprising the steps of:

outputting a preset first voltage to a gate driving line of a pixel row prior to the transistor turn-on time of the pixel row, wherein the first voltage is greater than a transistor turn-off voltage; and outputting a transistor turn-on voltage to the gate driving line of the pixel row when it reaches the transistor turn-on time, wherein the step of outputting a preset first voltage to a gate driving line of a pixel row prior to the transistor turn-on time of the pixel row comprises: outputting a preset first voltage to the gate driving line of the pixel row from a preset time period prior to the transistor turn-on time of the pixel row, wherein the preset time period is less than the time difference between the transistor turn-off time of the pixel row and the transistor turn-on time of the pixel row, the preset time period is approximately 10% of the time difference between the transistor turn-off time and the transistor turn-on time.

2. The method according to claim 1, wherein the first voltage is less than the transistor turn-on voltage.

3. The method according to claim 1, wherein the method further comprises:

stopping outputting the transistor turn-on voltage to the gate driving line of the pixel row, but outputting the transistor turn-off voltage to the gate driving line, when it reaches the transistor turn-off time of the pixel row.

4. The method according to claim 1, wherein the step of outputting a preset first voltage to a gate driving line of a pixel row prior to the transistor turn-on time of the pixel row comprises:

outputting the preset first voltage to the gate driving line of the pixel row under the control of a first control signal, prior to the transistor turn-on time of the pixel row.

5. The method according to claim 4, wherein the step of outputting a transistor turn-on voltage to the gate driving line of the pixel row when it reaches the transistor turn-on time comprises:

under the control of a second control signal, stopping outputting the first voltage to the gate driving line, but outputting the transistor turn-on voltage to the gate driving line, when it reaches the transistor turn-on time.

6. The method according to claim 5, wherein the method further comprises:

under the control of the second control signal, stopping outputting the transistor turn-on voltage to the gate driving line, but outputting the transistor turn-off voltage to the gate driving line, when it reaches the transistor turn-off time of the pixel row.

7. A gate drive circuit, comprising:

a precharge module configured to output a preset first voltage to a gate driving line of a pixel row prior to the transistor turn-on time of the pixel row, wherein the first voltage is greater than a transistor turn-off voltage;

a control module configured to output a transistor turn-on voltage to the gate driving line of the pixel row when it reaches the transistor turn-on time, wherein the precharge module is configured to: output the preset first voltage to the gate driving line of the pixel row from a preset time period prior to the transistor turn-on time of the pixel row, wherein the preset time period is less than the time difference between the transistor turn-off time of the pixel row and the transistor turn-on time of the pixel row, the preset time period is approximately 10% of the time difference between the transistor turn-off time and the transistor turn-on time.

8. The gate drive circuit according to claim 7, wherein the first voltage is less than the transistor turn-on voltage.

9. The gate drive circuit according to claim 7, wherein the control module is also configured to:

stop outputting the transistor turn-on voltage to the gate driving line, but output the transistor turn-off voltage to the gate driving line, when it reaches the transistor turn-off time of the pixel row.

10. The gate drive circuit according to claim 7, wherein the precharge module is configured to:

output the preset first voltage to the gate driving line of the pixel row under the control of a first control signal, prior to the transistor turn-on time of the pixel row.

11. The gate drive circuit according to claim 10, wherein the control module is configured to:

under the control of a second control signal, stop outputting the first voltage to the gate driving line, but output the transistor turn-on voltage to the gate driving line, when it reaches the transistor turn-on time.

12. The gate drive circuit according to claim 11, wherein the control module is also configured to:

under the control of the second control signal, stop outputting the transistor turn-on voltage to the gate driving line, but output the transistor turn-off voltage to the gate driving line, when it reaches the transistor turn-off time of the pixel row.

13. A display device comprising a gate drive circuit that is configured for gate driving of the pixel rows of the display device, wherein the gate drive circuit comprises:

a precharge module configured to output a preset first voltage to a gate driving line of a pixel row prior to the transistor turn-on time of the pixel row, wherein the first voltage is greater than a transistor turn-off voltage;

a control module configured to output a transistor turn-on voltage to the gate driving line of the pixel row when it reaches the transistor turn-on time, wherein the precharge module is configured to: output the preset first voltage to the gate driving line of the pixel row from a preset time period prior to the transistor turn-on time of the pixel row, wherein the preset time period is less than the time difference between the transistor turn-off time of the pixel row and the transistor turn-on time of the pixel row, the preset time period is approximately 10% of the time difference between the transistor turn-off time and the transistor turn-on time.

14. The display device according to claim 13, wherein the first voltage is less than the transistor turn-on voltage.

* * * * *